US008413828B2

(12) United States Patent
Hockema

(10) Patent No.: US 8,413,828 B2
(45) Date of Patent: Apr. 9, 2013

(54) HOIST ATTACHMENT FOR SKID STEER

(76) Inventor: Mark A. Hockema, Lafayette, IN (US)

( * ) Notice: Subject to any disclaimer, the term of this patent is extended or adjusted under 35 U.S.C. 154(b) by 330 days.

(21) Appl. No.: 12/662,469

(22) Filed: Apr. 19, 2010

(65) Prior Publication Data

US 2010/0301001 A1 Dec. 2, 2010

Related U.S. Application Data

(60) Provisional application No. 61/213,291, filed on May 27, 2009.

(51) Int. Cl.
*B66C 23/18* (2006.01)

(52) U.S. Cl.
USPC ..... 212/179; 212/180; 212/181; 414/686

(58) Field of Classification Search ..... 212/179, 212/180, 181, 230, 231, 264, 343, 175; 414/686, 414/680, 920, 703
See application file for complete search history.

(56) References Cited

U.S. PATENT DOCUMENTS 2,564,169 A 8/1951 Morgan et al.
2,760,661 A 8/1956 Wight et al.
3,106,253 A * 10/1963 Silver et al. ..... 172/239
3,294,262 A 12/1966 Person
4,540,096 A 9/1985 Orvis
5,054,989 A 10/1991 Fell
5,120,186 A 6/1992 Jorgenson
6,588,513 B1 * 7/2003 Gustafson ..... 172/439

* cited by examiner

*Primary Examiner* — Michael Mansen
*Assistant Examiner* — Juan Campos, Jr.
(74) *Attorney, Agent, or Firm* — Richard C. Litman

(57) ABSTRACT

The hoist attachment for skid steer includes a base frame with a mounting bracket and ball joint brackets to securely mount the hoist attachment to the skid steer. A telescoping boom is pivotally mounted to the top of the base frame. A pipe rack may be disposed adjacent the top of the base frame to store pipes or additional equipment. Pairs of hydraulic and manual support legs are attached to the base frame to stabilize the hoist attachment during working conditions. The power source for the hoist attachment is directly supplied by the hydraulic system in the skid steers. The hoist attachment includes controls operating the primary winch, boom, and hydraulic support legs. The base frame also includes a plug to which a remote may be attached for remote operation, the plug being connected to an electrical power source.

11 Claims, 6 Drawing Sheets

HOIST ATTACHMENT FOR SKID STEER

CROSS-REFERENCE TO RELATED APPLICATION

This application claims the benefit of U.S. Provisional Patent Application Ser. No. 61/213,291, filed May 27, 2009.

1. FIELD OF THE INVENTION

The present invention relates to front end loaders, and more specifically to a portable hoist attachment for a skid steer that uses power from the skid steer to operate a hoist system in a stable manner.

2. DESCRIPTION OF THE RELATED ART

Skid steers are compact loaders that have a wide range of utility from agriculture to construction. The compact size, tight turning radius, and ease of handling are some of the features that make skid steers attractive in a typical working environment. The generic use of these vehicles resides in scooping material into a bucket or scoop attached to angled lifting arms on the skid steer to be hauled from place to place. While the traditional function of these vehicles garner its own range of utility, skid steers serve as a base upon which numerous attachments or accessories may be mounted to greatly increase its versatility. Some of these attachments include angled booms, backhoes, earth augers and utility forks.

Although a variety of attachments or accessories are available, there appears to be a scarcity of crane-type attachments, mainly due to the balance and stability concerns for such an attachment. In other words, the size and weight of the skid steer limits how much load can be carried in the front because too much weight can cause the skid steer to tip forward. One solution includes a small crane with a universal mounting bracket attachable to a skid steer. While functional in lifting objects, this solution is very limited in capacity as well as safe handling due to a lack of means to stabilize the overall structure if the weight exceeds that of the skid steer. Another solution includes a portable loader with a complicated attachment means that utilize the undercarriage of the vehicle. This system appears to be able to handle large loads due to the size of the crane, but it appears to be relatively heavy and more suitable for large tractors rather than compact skid steers. It would advantageous in the art to provide a safe, stable crane attachment for a skid steer capable of handling large loads.

Thus, a hoist attachment for skid steer solving the aforementioned problems is desired.

SUMMARY OF THE INVENTION

The hoist attachment for a skid steer includes a base frame with a mounting bracket and ball joint brackets to securely mount the hoist attachment to the skid steer. A telescoping boom is pivotally mounted to the top of the base frame. A pipe rack may be disposed adjacent the top of the base frame to store pipes or additional equipment. Pairs of hydraulic and manual support legs are attached to the base frame to stabilize the hoist attachment during working conditions. The power source for the hoist attachment is directly supplied by the hydraulic system in the skid steers. The hoist attachment includes controls operating the primary winch, boom, and hydraulic support legs. The base frame also includes a plug to which a remote may be attached for remote operation, the plug being connected to an electrical power source.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
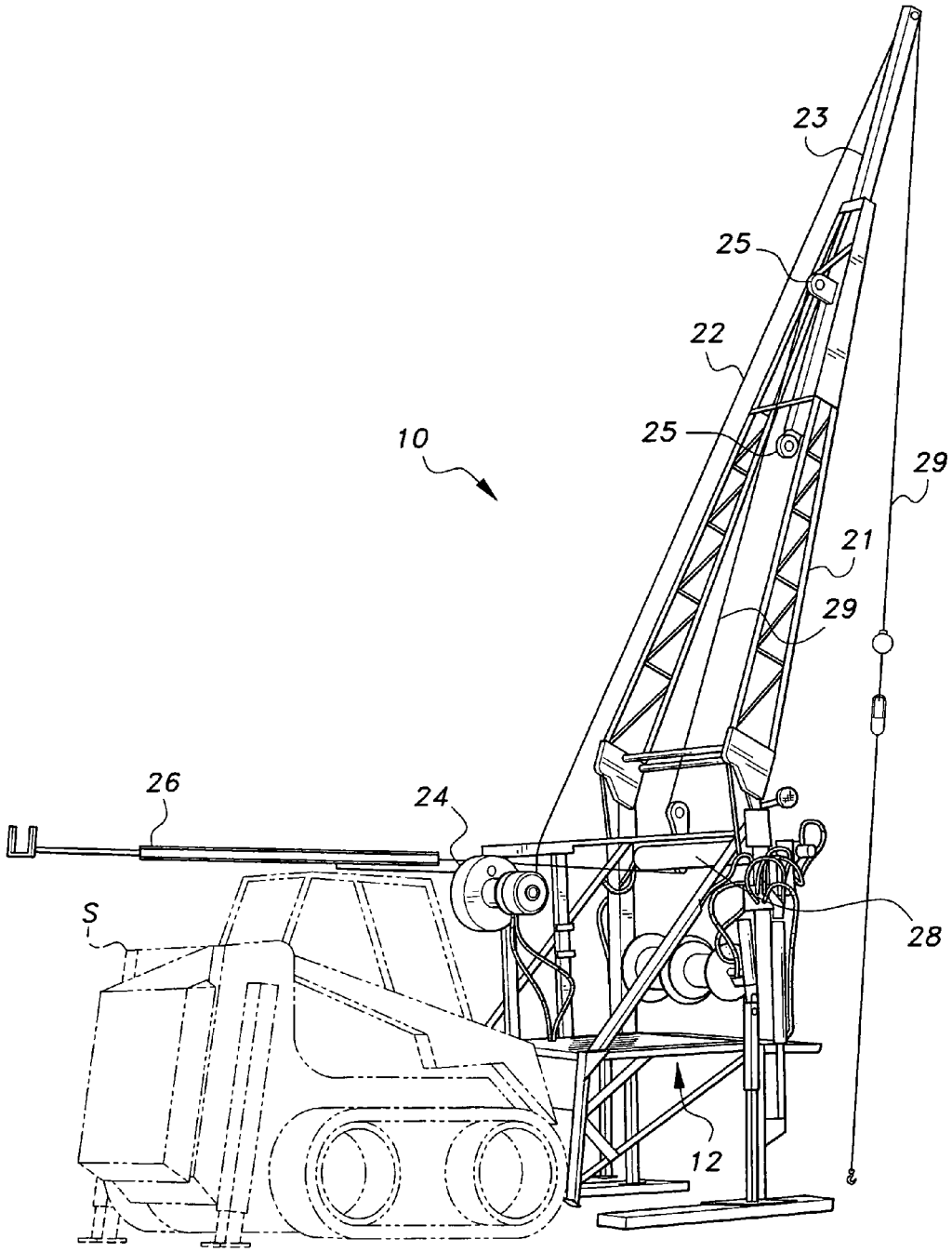
FIG. 1 is an environmental, perspective view of a hoist attachment for a skid steer according to the present invention.
Figure 2:
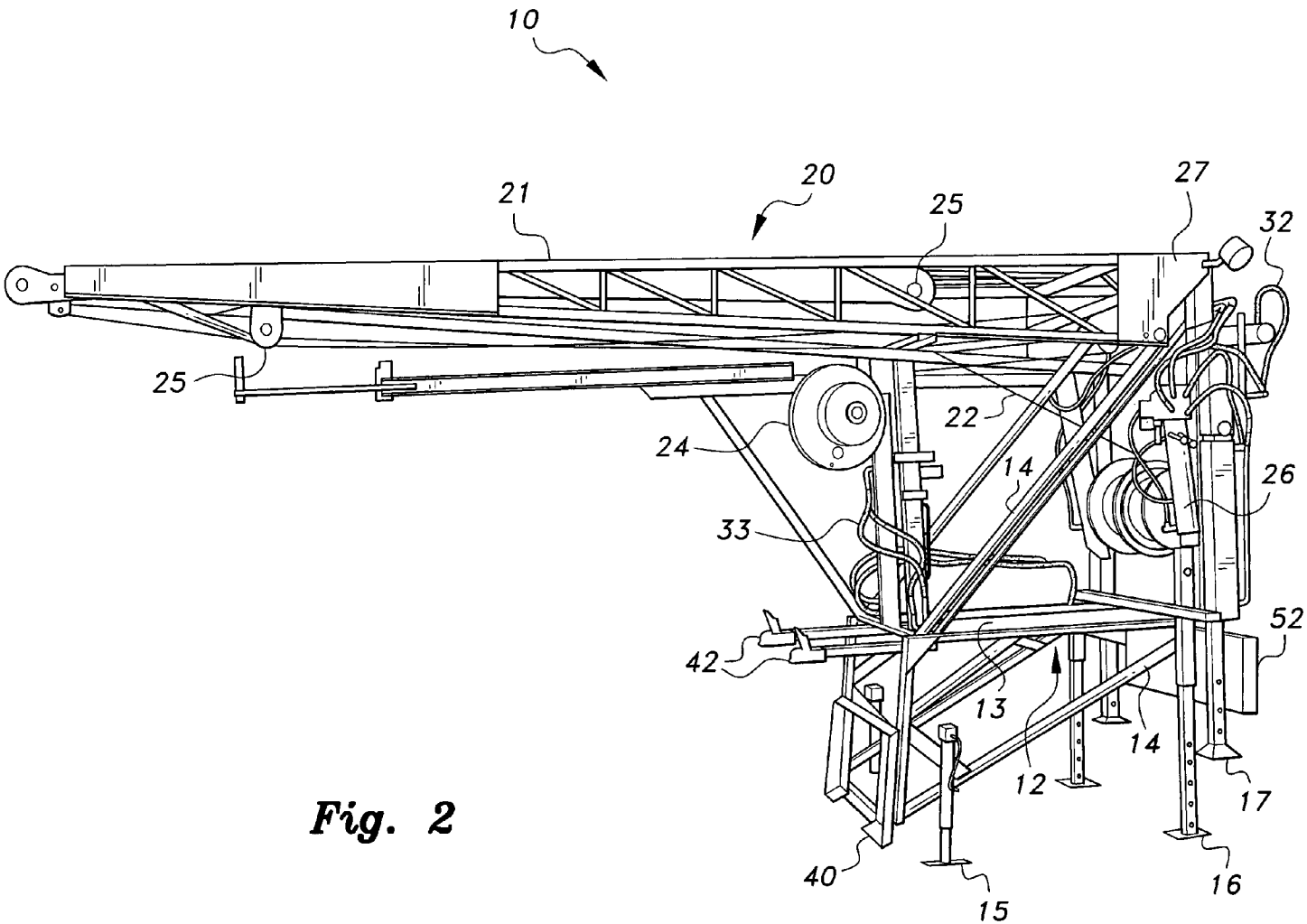
FIG. 2 is a perspective view of the hoist attachment for a skid steer according to the present invention.

The present invention relates to a hoist attachment for skid steer, generally referred to by reference number 10, constructed for safe and stable operation even for relatively heavy loads. As shown in FIGS. 1 and 2, the hoist attachment 10 includes a base frame 12 defined by a plurality of tubular members forming a substantially square shape. Cross braces 14 provide structural rigidity to the base frame 12. A storage platform 13 is disposed intermediate the frame 12 where equipment and other accessories may be stored.

The hoist or crane system is pivotally mounted at the top of the base frame 12. The hoist includes a telescoping boom 20 pivotal about pivot 27. The telescoping boom 20 is comprised of an extendable boom or arm 23 housed in a boom frame 21. The boom frame 21 is preferably a pyramidal lattice of trusses, which is sturdy and lightweight. However, other frame configurations, e.g., solid rails, may be used provided there is no dramatic increase in weight. The boom 23 is an elongated, substantially tubular beam having a series of pulleys 25 through which the boom cable 29 is wound. One end of the boom cable 29 is wound on a primary or boom winch 24. The other end of the cable 29 is operatively connected to attachments for the intended work. Thus, operation of the boom wench 24 raises or lowers the boom 23 and the object attached thereto via cable 29. A stabilizing cable 22 is attached to the base frame 12 at one end and the other end is attached to the distal end of boom 23 to control and stabilize the movement of the telescoping boom 20.

The hoist attachment 10 also includes a secondary winch 28 disposed on the base frame 12. The secondary winch 28 may be of a different specification, e.g., less power, faster wind speed, suitable for a different workload environment. Moreover, the hoist attachment 10 may also be provided with an elongated rack 26 attached to the top of the base frame 12. The rack 26 is adapted to hold pipes or other types of elongated parts.

To stabilize the hoist attachment 10, both at rest and during work, the hoist attachment includes a plurality of stabilizing or support legs. These support legs provide safety and stability to the structure, which is much need due to the cantilevered configuration of the hoist attachment 10 and the weight or load imbalances inherent in crane or hoist operation. A first pair of support legs 15 are disposed adjacent the back end of the base frame 12 on opposing lateral sides thereof. These support legs 15 are manual or crank operated. A second pair of manual support legs 16 are disposed adjacent the front end of the base frame 12 to provide support thereon. To ensure stability under load, a third pair of hydraulically operated support legs 17 are provided outwardly of the front end of the base frame 12.

Figure 3:
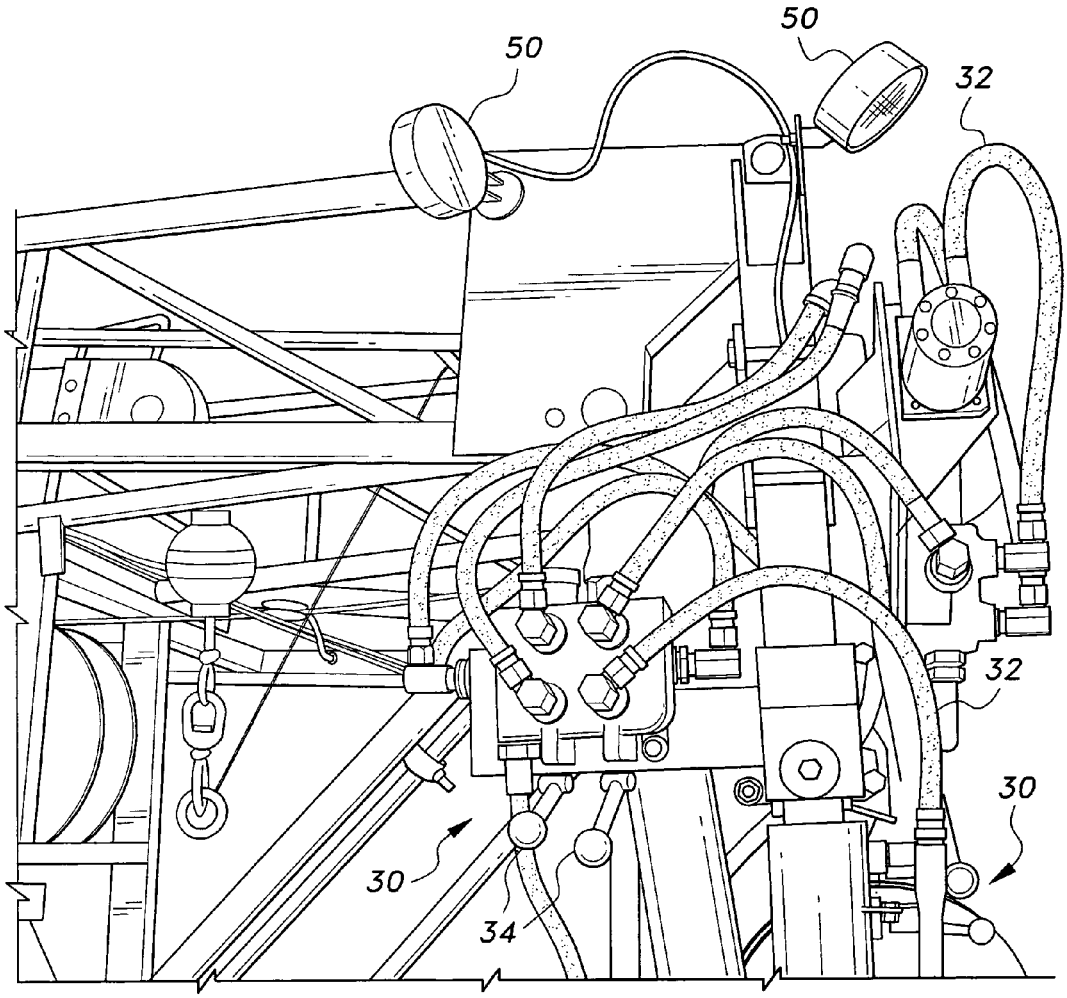
FIG. 3 is an enlarged perspective view of the controls for the hydraulic support legs on the hoist attachment for a skid steer according to the present invention.
Figure 4:
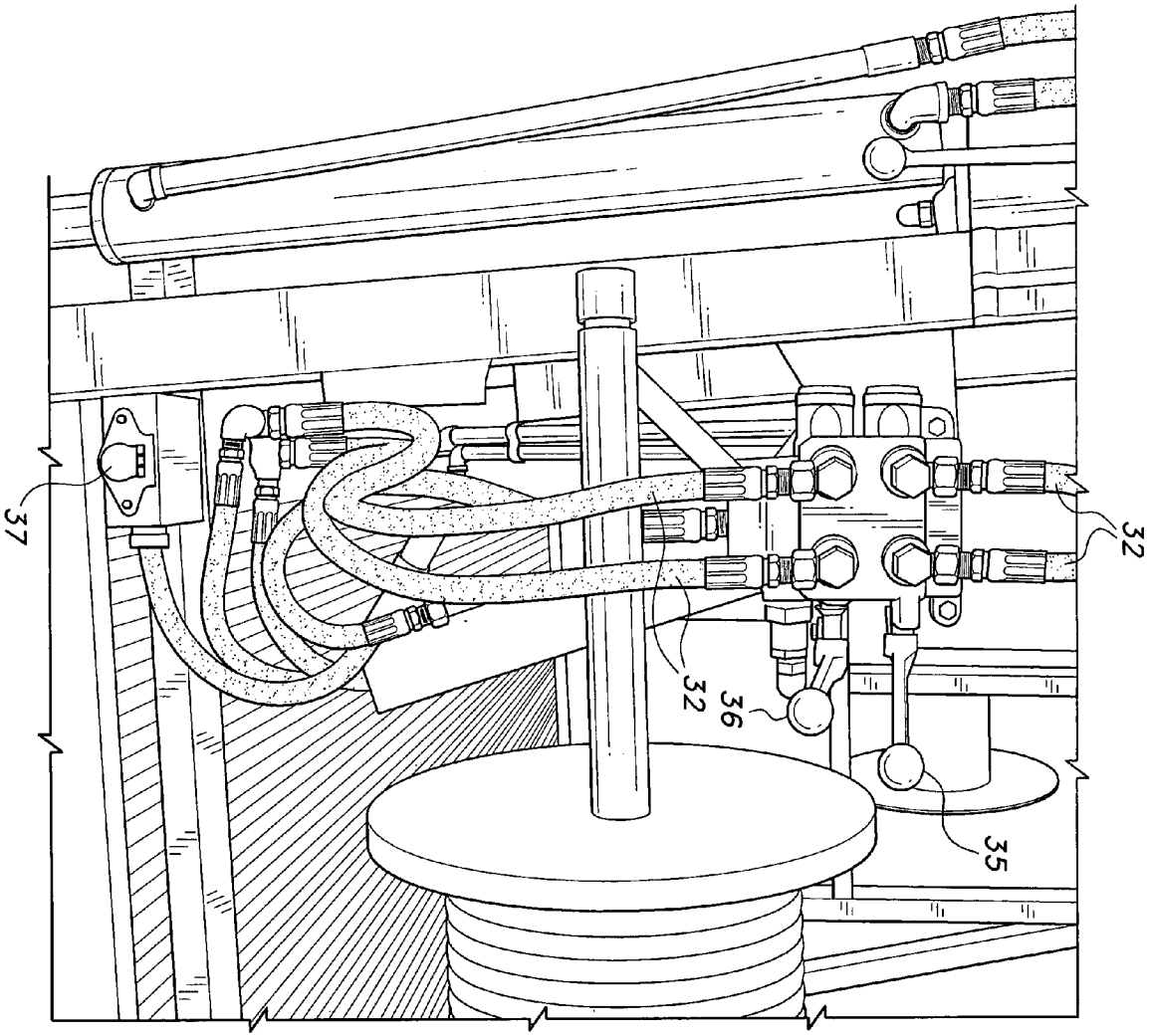
FIG. 4 is an enlarged perspective view of the controls for the boom and hoist on the hoist attachment for a skid steer according to the present invention.

Referring to FIGS. 3 and 4, operation of the hoist attachment 10 is facilitated by hydraulic controls 30. When the hoist attachment 10 is mounted to the skid steer S, the hydraulic line 33 is attached to the hydraulics of the skid steer S to provide operative power to the hoist attachment 10. Other hydraulic lines 32 connect to the telescoping boom 20 and the hydraulic support legs 17. On one lateral side of the base frame 12, the controls 30 include control levers 34 to selectively raise or lower either support legs 17. The rear side of the base frame 12 has controls 30 that include a boom control lever 35 and hoist control lever 36. The boom control lever 35 operates the primary winch 24 to extend or retract the boom 23. The hoist control lever 36 operates the lift cylinder 26 to raise or lower the boom frame 21. As an alternative, the controls 30 include an adapter plug or socket 37 on the rear side of the frame 12 whereby a remote may be attached thereto to operate the hoist attachment 10 from a safe distance. The rear side also includes a foldable bench 52 that a user may sit or place equipment.

Figure 5:
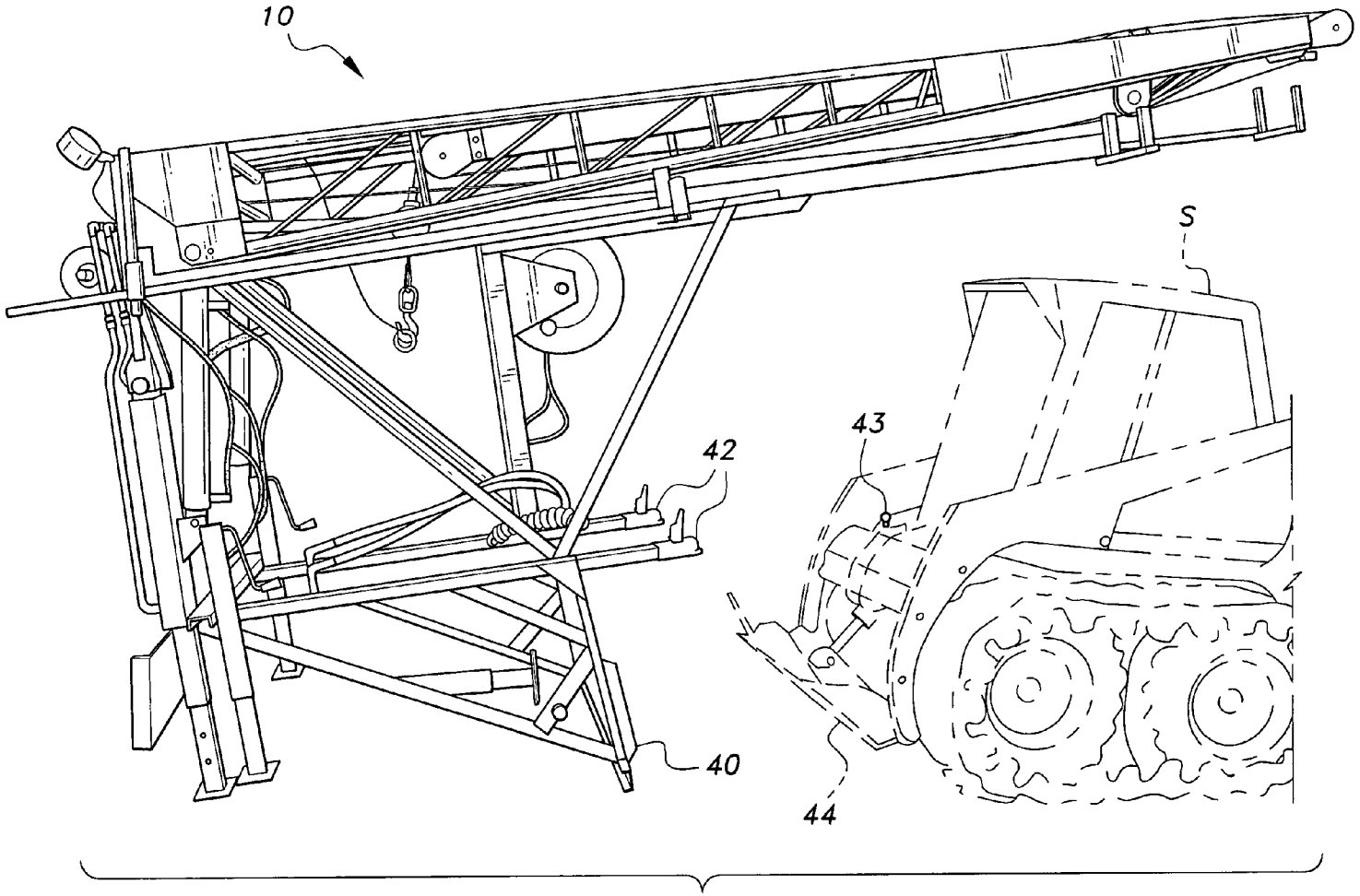
FIG. 5 is an environmental perspective view of the hoist attachment for a skid steer according to the present invention, shown in the process of being mounted to a skid steer.
Figure 6:
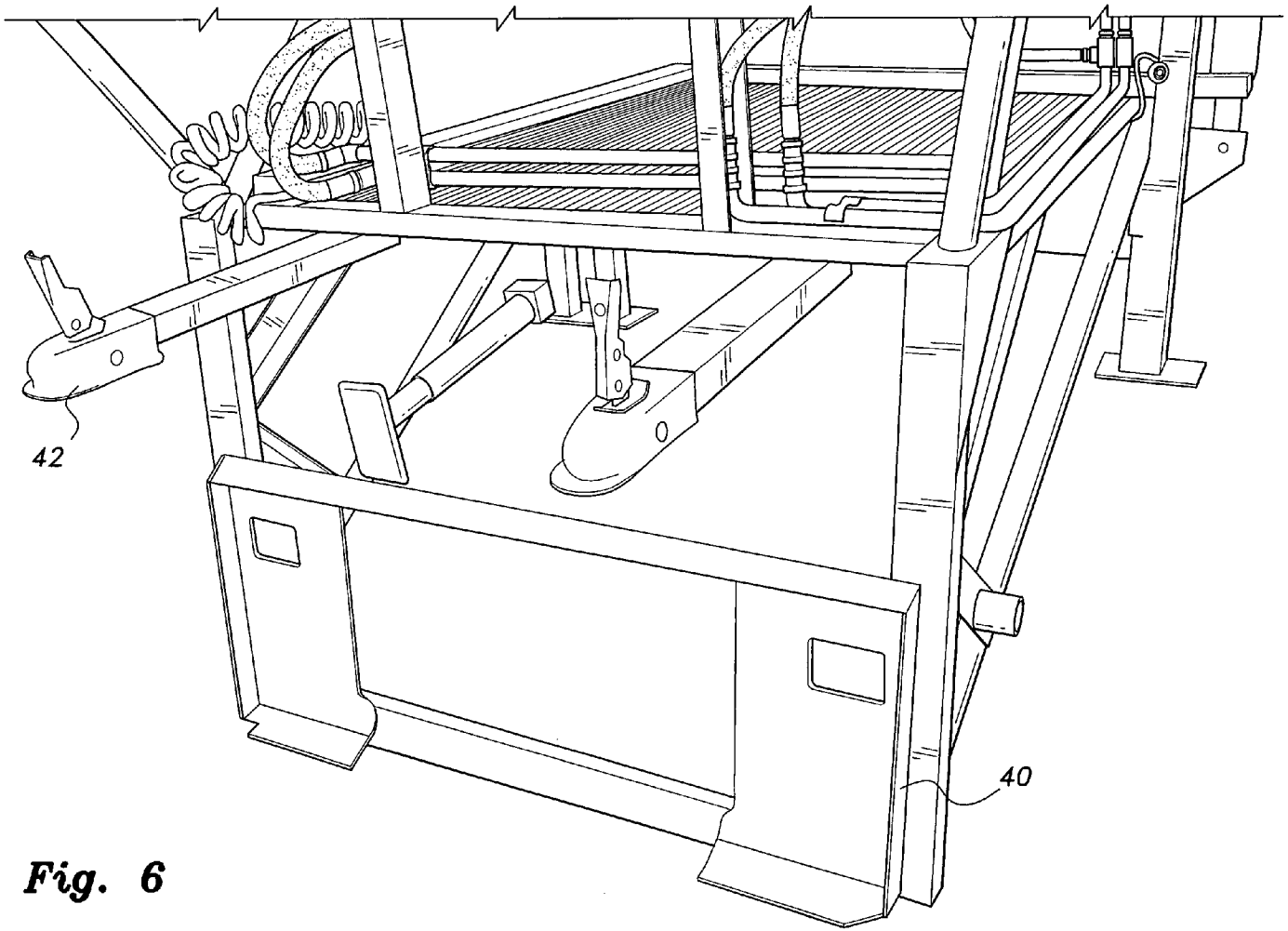
FIG. 6 is an enlarged perspective view of the mounting mechanism for the hoist attachment for a skid steer according to the present invention.

To attach the hoist attachment 10 to a skid steer S, the hoist attachment 10 includes a three-point mounting means. Referring to FIGS. 5 and 6, the front of the base frame 12 includes a skid mounting bracket 40 and a pair of ball joint brackets 42 extending from the storage platform 13. The ball joints brackets 13 are similar to trailer hitches and configured to mount on the ball joints 43 disposed on the hood of the skid steer S, while the skid mounting bracket 40 is configured to mount on the skid tongue 44. The skid mounting bracket 40 includes holes and overhanging lip areas to facilitate secure insertion of the skid tongue 44.

The following describes how to use the hoist attachment 10. As note above, the user operates a skid steer S to steer the skid tongue 40 into the mounting bracket. Once inserted, the ball joint brackets 42 are in substantially alignment with the ball joints 43 whereby the ball joint brackets 42 may be maneuvered and locked onto the ball joints 43. It should be noted that once mounted, there is a stable balance in weight due, in part, to the telescoping boom 20 extending to the rear of the skid steer. This results in a center of mass that is closer to or on the skid steer S rather than the front of the hoist attachment 10. The skid steer S is then driven to the work site where the user attaches the hydraulic hose 33 to the hydraulics of the skid steer S. Depending on the intended loads for hoist operation, the user may then selectively extend support legs 15, 16, 17 to ensure a safe and stable foundation for the work. If light conditions are not good, the hoist attachment 10 also includes lights 50 which may be directed to the desired location. Thus, it can be seen that the hoist attachment 10 provides a safe working environment for a wide range of workloads.

It is to be noted that the hoist attachment 10 encompasses a variety of alternatives. For example, the hoist attachment 10 is preferably made of steel, but other materials such as composites, aluminum or other sturdy materials may also be used. The hoist attachment 10 may be painted in a variety of colors and/or provided with indicia thereon. The power source is also not limited to the hydraulics of the skid steer S. Electric power may be used via batteries, generators or fuel cells.

It is to be understood that the present invention is not limited to the embodiments described above, but encompasses any and all embodiments within the scope of the following claims.

I claim:

1. A hoist attachment for skid steer, comprising:

a base frame having a top, a bottom, a front, a back and lateral sides;

a telescoping boom pivotally mounted to the top of the base frame at a pivot located at the back of the base frame, the telescoping boom extending substantially past the front of the base frame, wherein the telescoping boom includes a boom frame and an elongate, selectively extendable arm slidably disposed in the boom frame;

a pair of lift cylinders located adjacent opposing lateral sides at the back of the base frame and operatively connected to the telescoping boom;

a primary winch attached to the front of the base frame, the primary winch having a given operational parameter and a cable wound thereon, the cable being operatively connected to the elongate selectively extendable arm;

a plurality of selectively extensible stabilizing support legs disposed around the bottom of the base frame to provide a stable resting and working foundation, wherein at least one pair of extensible stabilizing support legs are in substantial vertical alignment with the pivot;

a three-point mounting hitch adapted for attaching to a skid steer, the three-point mounting hitch being disposed on the front of the base frame and in substantial vertical alignment with the primary winch, the three-point mounting hitch further comprises:

a pair of ball joint brackets mounted to the base frame and extending away from the front of the base frame, the ball joint brackets being adapted for attachment to ball joints on the skid steer; and a mounting bracket disposed on a lower portion of the front of the base frame, the mounting bracket being adapted for seating on a skid tongue from the skid steer; and a control system connected to at least the boom and a power source for controlling operation of the telescoping boom.

2. The hoist attachment for skid steer according to claim 1, wherein said boom frame comprises a pyramidal lattice of trusses.

3. The hoist attachment for skid steer according to claim 1, further comprising a secondary winch, the secondary winch having different operational parameters from said primary winch.

4. The hoist attachment for skid steer according to claim 1, wherein said plurality of stabilizing support legs comprises at least one pair of manual, extendable legs, the manual, extendable legs being selectively deployed to stabilize said base frame.

5. The hoist attachment for skid steer according to claim 1, wherein said plurality of stabilizing support legs comprises at least one pair of powered, extendable legs, said powered, extendable legs being selectively deployed to stabilize said base frame.

6. The hoist attachment for skid steer according to claim 5, wherein said power source comprises hydraulic power from the skid steer, said control system being selectively operable to extend and retract said at least one pair of powered, extendable legs.

7. The hoist attachment for skid steer according to claim 1, wherein said power source comprises hydraulic power from the skid steer.

8. The hoist attachment for skid steer according to claim 1, wherein said control system further comprises a socket for connecting a remote control operable for remote operation of said telescoping boom.

9. The hoist attachment for skid steer according to claim 1, further comprising a foldable bench attached to said base frame to provide a seating and storage area.

10. The hoist attachment for skid steer according to claim 1, further comprising at least one light source disposed on said base frame to illuminate a working area.

11. The hoist attachment for skid steer according to claim 1, further comprising a rack disposed adjacent the top of said base frame to store pipes and additional equipment.

* * * * *